United States Patent [19]

Gould et al.

[11] Patent Number: 4,520,946

[45] Date of Patent: Jun. 4, 1985

[54] PACKAGE STRUCTURE

[75] Inventors: Jerome Gould, Encino; Thomas W. Kellogg, Irvine, both of Calif.

[73] Assignee: James River-Norwalk, Inc., Norwalk, Conn.

[21] Appl. No.: 550,925

[22] Filed: Nov. 10, 1983

Related U.S. Application Data

[63] Continuation of Ser. No. 338,867, Jan. 12, 1982, abandoned.

[51] Int. Cl.[3] ..... B65D 5/16; B65H 1/00

[52] U.S. Cl. ..... 221/63; 221/34; 206/499

[58] Field of Search ..... 221/33, 34, 45, 61–63, 221/92, 103, 104, 106, 107, 111, 221, 282, 303, 305, 307–311, 312 C; 206/499, 500, 509, 497; 312/43

[56] References Cited

U.S. PATENT DOCUMENTS

| | | | |
|---|---|---|---|
| 1,201,963 | 10/1916 | Hill | 221/63 |
| 1,337,838 | 4/1920 | Hammond et al. | 221/33 X |
| 2,335,914 | 12/1943 | Buttery | 221/63 |
| 2,543,746 | 3/1951 | Morrison | 221/63 X |
| 2,804,236 | 8/1957 | Piazze | 221/307 X |
| 3,331,533 | 7/1967 | Krugger | 221/310 X |
| 3,563,411 | 2/1971 | Carroll | 221/63 |
| 3,853,217 | 12/1974 | Scordato et al. | 206/499 X |
| 4,119,202 | 10/1978 | Roth | 206/497 X |
| 4,163,508 | 8/1979 | Mannor | 221/310 |

*Primary Examiner*—Joseph J. Rolla
*Assistant Examiner*—Kevin P. Shaver
*Attorney, Agent, or Firm*—William A. Aguele; Harry W. Hargis, III; Thomas H. Whaley

[57] ABSTRACT

A package includes two or more individual cup dispensing units, each unit comprising a carton holding a stack of nested tapered cups. Each carton of a dispensing unit is of paperboard having a generally circular opening in a top wall through which the tapered cups protrude, and which opening is surrounded by a series of short radial knife cuts defining a series of yieldable tabs on the wall which permit the topmost protruding cup to be pulled through the opening, but which function to restrain the cups immediately below. The bottom wall of the carton is formed with a generally circular opening, either fully cut-out or defined by a series of radial cuts, which permits the protruding tapered cups of a similar, adjacent carton to extend through the bottom opening into the carton to form a compact, multiple dispensing unit package which is shrink wrapped for shipping and display.

3 Claims, 7 Drawing Figures

PACKAGE STRUCTURE

This is a continuation of application Ser. No. 338,867, filed Jan. 12, 1982, now abandoned.

BACKGROUND OF THE INVENTION

This invention relates to packaging, and more particularly to package structure for stacks of nested cups that serves also as apparatus for dispensing the cups.

Cup dispensers are well known in the art and generally require some form of permanent mounting on a wall or other suitable structure. It is not always practicable to mount a dispenser of this type in every desired location, and they frequently are mounted in a single location not convenient to all users.

It is an objective of this invention to provide an improved package structure for nested paper cups that is suited as dispensing apparatus useful in a variety of locations.

It is a further objective of the invention to provide an improved package structure for nested cups that is separable into self contained units each serving as a dispensing apparatus, and which units are adapted for use without need for permanent mounting structure.

SUMMARY OF THE INVENTION

In achievement of the foregoing as well as other objectives, the invention contemplates an improved package structure including at least a pair of separable units, each unit adapted to serve as a cup dispensing apparatus and comprising: a container having substantially planar, parallel, mutually spaced first and second walls, each said wall including a generally circular opening, the opening in said first wall axially aligned with the opening in said second wall; said container being adapted to hold a stack of nested cups each having a tapered side wall, a circular bottom wall, and a circular open top, said bottom wall being smaller than either of said openings, and said open end being greater than at least said opening in said second wall, whereby said stack protrudes through said opening in said second wall at its one end and rests on said second wall in the region of the opening therein, the recited protruding stack of one of said containers extending through said opening in said second wall of the other of said containers so that said last recited second wall is disposed in engagement with the first wall of the recited one container, said cups being dispensible by grasping a protruding cup and removing it through said first opening of a container, either in the recited assembled mode of said units or in the separated mode thereof.

The manner in which the foregoing as well as the other objectives of the invention may best be achieved will be more fully understood from a consideration of the following description, taken in light of the accompanying drawing.

DESCRIPTION OF THE PREFERRED EMBODIMENT

Figure 1:
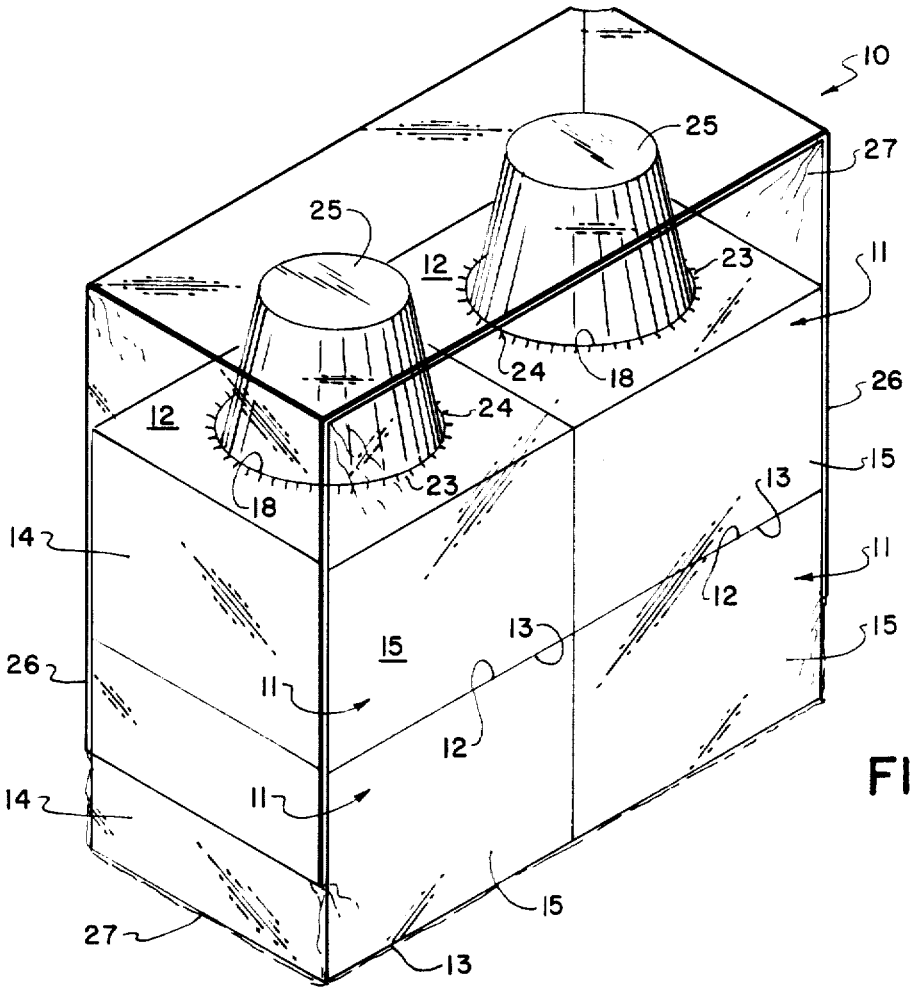
FIG. 1 is a perspective view of a package of nested cups embodying the invention.
Figure 2:
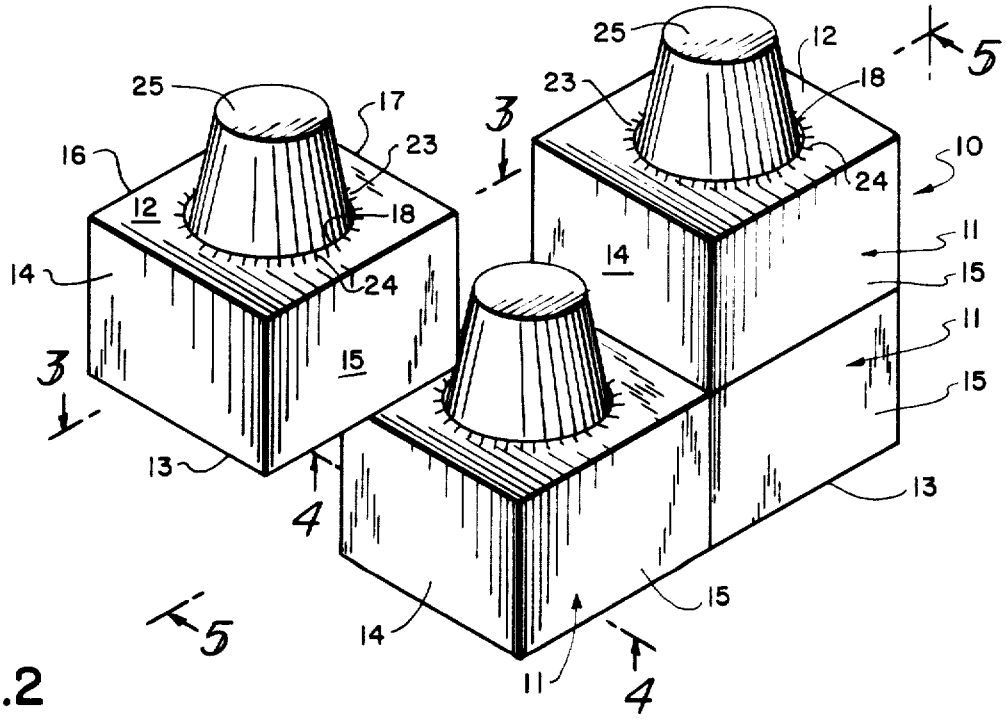
FIG. 2 is a perspective view of the package in FIG. 1, in a partially disassembled mode.
Figure 3:
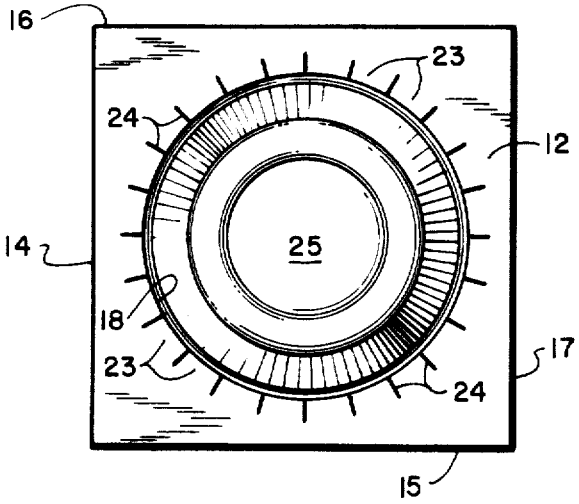
FIG. 3 is a top plan view of a portion of the package in FIG. 2, looking in the direction of arrows 3—3.

With more detailed reference to the drawing, there is seen in FIG. 1 a package 10 of two pairs of stacked units 11, each identical to the other and comprising containers or cartons of paperboard serving as dispensing apparatus. Referring also to FIGS. 2 and 3, each carton 11 is of generally rectangular configuration, including planar, parallel, mutually spaced first and second walls 12 and 13, respectively, joined by planar side walls 14, 15, 16 and 17.

Figure 4:
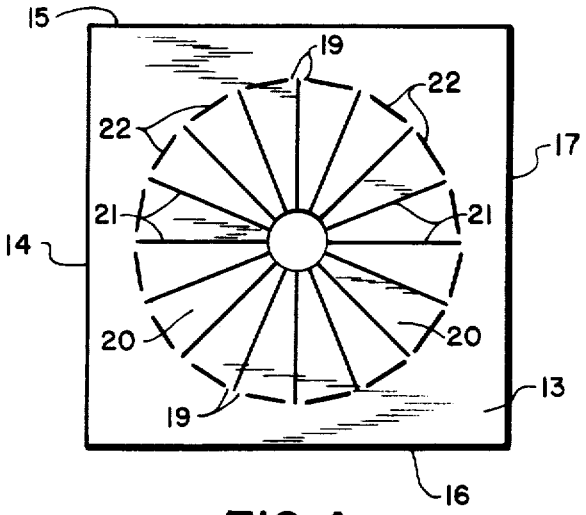
FIG. 4 is a bottom plan view of a portion of the package in FIG. 2, looking in the direction of arrows 4—4.

As is seen also in FIG. 3, first or upper wall 12 includes a generally circular opening 18, and, as is seen in FIG. 4, second or lower wall 13 includes a generally circular opening 19 axially aligned with opening 18. Opening 19 preferably is smaller or of lesser diameter than opening 18, and along its periphery there are provided radially inwardly projecting tabs 20 defined by radial knife cuts 21 in lower wall 13. Tabs 20 are connected to wall 13, along the periphery of opening 19, and include perforations 22 extending transversely of the bases of the tabs so that the perforations are substantially aligned with the periphery of opening 19. The upper opening 18 preferably is larger or of greater diameter than opening 19, and is substantially defined by tabs 23 which, in turn, are defined by relatively short radial knife cuts 24.

Figure 5:
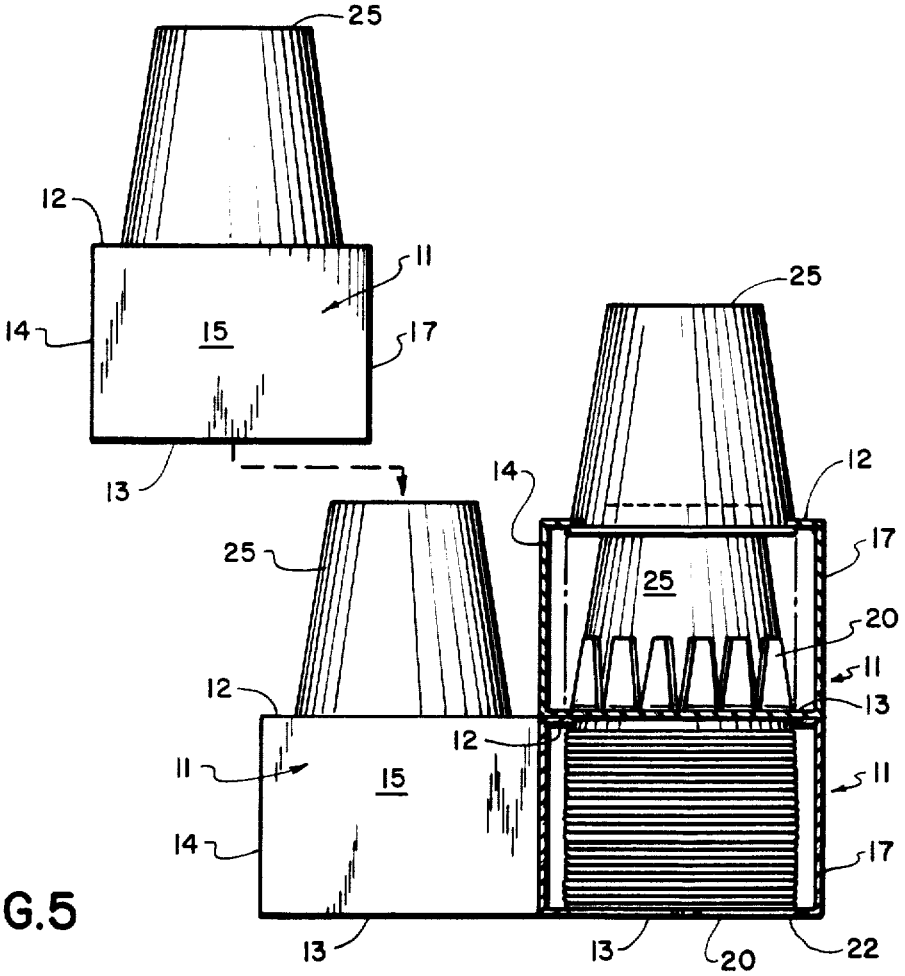
FIG. 5 is an elevational showing of the package in FIG. 2, with a portion sectioned generally along the line 5—5.

As is seen to advantage in FIG. 5, an inverted stack of rolled rim tapered cups 25 is disposed in each carton 11, wherein the tapered side wall and bottom wall of the end cup of a cup stack protrudes through the larger opening 18, and the open top of the other end cup of the same cup stack rests on the lower wall 13, in the region of perforations 22. Tabs 20 conveniently serve as a dust cover for the lower walls of a lowermost carton 11 of a package. Tabs 23 defining the upper opening 18 are sufficiently flexible and resilient, as is the nature of the paperboard of the carton, to accommodate one-at-a-time removal of protruding cups through opening 18.

As is further seen to advantage in FIG. 5, the pair of stacked cartons 11 are so positioned that the protruding end cup 25 of a cup stack in one carton 11, i.e lower carton, extends through the smaller opening 19 of the other carton 11, i.e. upper carton, flexing the radial tabs 20 about perforations 22 and being received in the open top of the bottom or lowermost cup of the inverted stack in the upper carton 11. Further to the paired cartons 11, the lower wall 13 of the upper carton is disposed in engagement with the upper wall 12 of the lower carton, whereby the upper carton is supported on the lower carton. To separate a pair of stacked cartons, one need only lift an upper carton to a position as shown in FIG. 5.

Assembly of the side-by-side pairs of cartons 11 as a package 10 is maintained by a sheet of flexible material such as a clear plastic film overwrap 27 (FIG. 1) held in the illustrated rectangular form over the protruding cup stacks by a flat rectangular sheet 26 of stiff plastic material in an inverted U-shape configuration, wherein the flat loop portion rests atop the inverted cup stacks and the leg portions are generally coplanar with the sides of the assembled cartons as shown.

While two pairs of cartons 11 are illustrated as making up the package 10, it will be appreciated that several pairs may be arranged side by side, in a single line, or in a square array, either being overwrapped with a clear plastic sheet or film as shown, and having a form also as shown to present a flat upper package surface facilitating stacking of several packages. Alternatively, where stacking of the packages is not contemplated, assembly of a package may be achieved using conventional shrink-wrapped film without the form 27.

Figure 6:
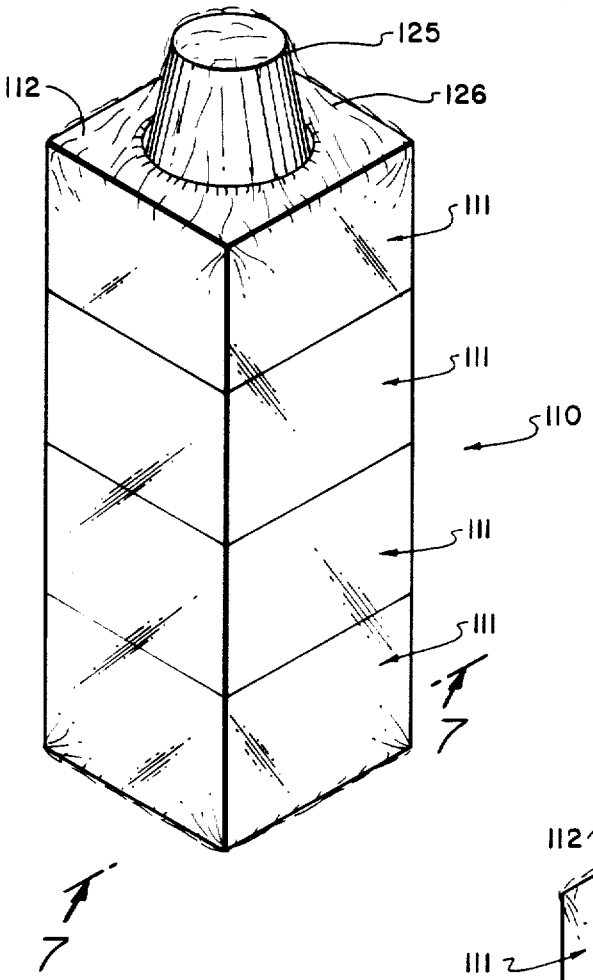
FIGS. 6 and 7 are perspective views, from above and below, respectively, of a modified embodiment of the invention.
Figure 7:
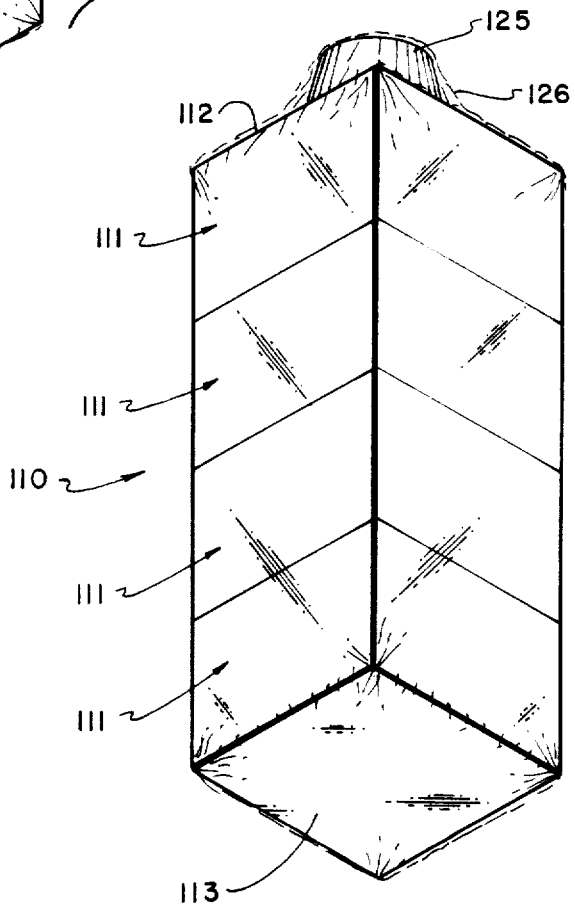

The invention also contemplates an alternative embodiment, as is seen in FIGS. 6 and 7, wherein two or more cartons 111 may be arranged atop one another in a package 110, and assembly may be maintained by clear wrapping film 126.

In any of the described combinations, the inventive structure achieves both practical and aesthetic qualities desired of a cup dispenser, affording an attractive, compact package capable of ready disassembly by the user into equally attractive, easy to use dispensing units.

While paperboard is the preferred material of the carton, it will be apparent from the foregoing that other materials affording adequate flexibility and resilience for flexure of the tabs, such as polyethylene or like plastics, or laminates including paperboard, plastic, or metal foil, will be suitable for use in achieving objectives and advantages of the invention.

It will be appreciated that the foregoing as well as other alternative embodiments may be resorted to without departing from the scope of the claims.

We claim:

1. A dispenser carton for packaging and separately dispensing a cup from a stack of rimmed tapered disposable cups each of which has a tapered sidewall, a bottom wall, and an open top surrounded by a rolled rim, comprising a container having substantially square planar parallel mutually spaced first and second end walls and connecting rectangular sidewalls; said first end wall including a central circular opening of a size sufficient to permit the bottom and tapered sidewall of a cup to extend freely therethrough and insufficient in size for the passage of the rim of a cup freely therethrough; a plurality of relatively short radial knife cuts extending outwardly from said opening and defining a plurality of relatively stiff flexible tabs normally lying in the plane of said first end wall while a cup is projecting through said opening and capable of being deflected in the direction of movement of a cup through said opening to permit passage of a cup therethrough solely by flexure of said tabs, thereby allowing the outermost cup to be withdrawn from the carton while retaining the remainder of the stack, said second end wall including an opening axially aligned with and smaller in diameter than the opening in said first end wall, said second end wall having a plurality of radial slits extending from said opening therein outwardly a distance from the center of said opening sufficient to exceed the radius of the small end of a cup but less than a distance equal to the radius of the large end of a cup.

2. A dispenser carton structure as defined in claim 1 wherein the distance between said first and second end walls is less than the height of a cup.

3. A dispenser carton as defined in claim 1 wherein a plurality of knife cuts in a generally circular pattern is provided in said second end wall at the outer ends of said radial slits defining a plurality of tabs in a non-intersecting relationship with said radial slits and forming a generally circular line of weakness facilitating bending of said tabs inwardly along fold lines defined by said pattern of knife cuts.

* * * * *